United States Patent [19]

Lahr

[11] 4,125,261

[45] Nov. 14, 1978

[54] TOY VEHICLE AND TOY VEHICLE GAME

[75] Inventor: Robert G. Lahr, Reseda, Calif.

[73] Assignee: Ideal Toy Corporation, Hollis, N.Y.

[21] Appl. No.: 807,997

[22] Filed: Jun. 20, 1977

Related U.S. Application Data

[60] Continuation-in-part of Ser. No. 783,722, Apr. 1, 1977, Pat. No. 4,078,799, which is a division of Ser. No. 747,441, Dec. 6, 1976, abandoned.

[51] Int. Cl.[2] ..... A63F 9/14

[52] U.S. Cl. ..... 273/86 B; 46/262

[58] Field of Search ..... 273/86 B, 251, 253, 273/254, 255, 256, 257, 258, 259, 260, 261, 262, 210, 211, 212, 213

[56] References Cited

U.S. PATENT DOCUMENTS

| | | | |
|---|---|---|---|
| 367,420 | 8/1887 | Luchs | 46/212 |
| 3,453,970 | 7/1969 | Hansen | 273/86 B X |
| 3,675,366 | 7/1972 | Tomiyama | 46/262 |
| 3,813,812 | 6/1974 | Barlow et al. | 46/259 |
| 3,965,612 | 6/1976 | Asano | 46/212 X |

FOREIGN PATENT DOCUMENTS

| | | | |
|---|---|---|---|
| 659,620 | 5/1938 | Fed. Rep. of Germany | 46/212 |

*Primary Examiner*—Anton O. Oechsle
*Attorney, Agent, or Firm*—Richard M. Rabkin

[57] ABSTRACT

A toy vehicle is provided for use in a toy vehicle game including an endless track defining at least two parallely extending vehicle lanes in which two or more toy vehicles are adapted to be operated. The toy vehicles each include a reversible rotary drive motor and a transmission operatively engaged between the motor and two drive wheels for rotating one or the other of the drive wheels, in response to the direction of rotation of the drive motor, thereby biasing the car against one or the other of the side walls of the track to guide the vehicle along its path of travel in one or the other of the lanes. The track includes electrical contact strips which supply power to the drive motor of the vehicles through current collectors mounted thereon. A control system permits the operators to separately and independently control current to the contact strips and also to selectively reverse the polarity of the current so that the operators can vary the speed of their associated vehicles and cause the vehicles to move from one lane to the other. The toy vehicle includes a swing gear responsive to the direction of rotation of the vehicle's drive motor for driving one or the other of the rear wheels of the vehicle.

11 Claims, 9 Drawing Figures

FIG. 4
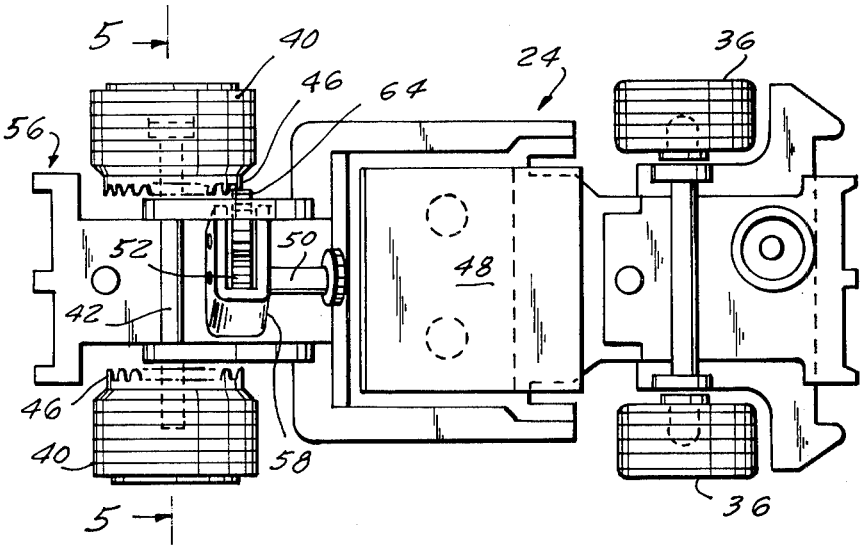
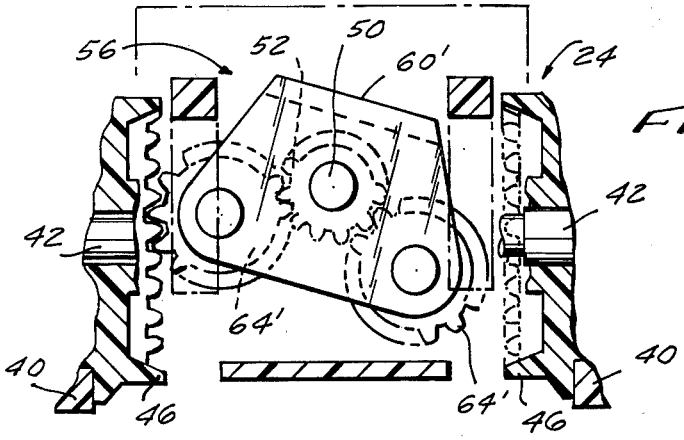
FIG. 5A
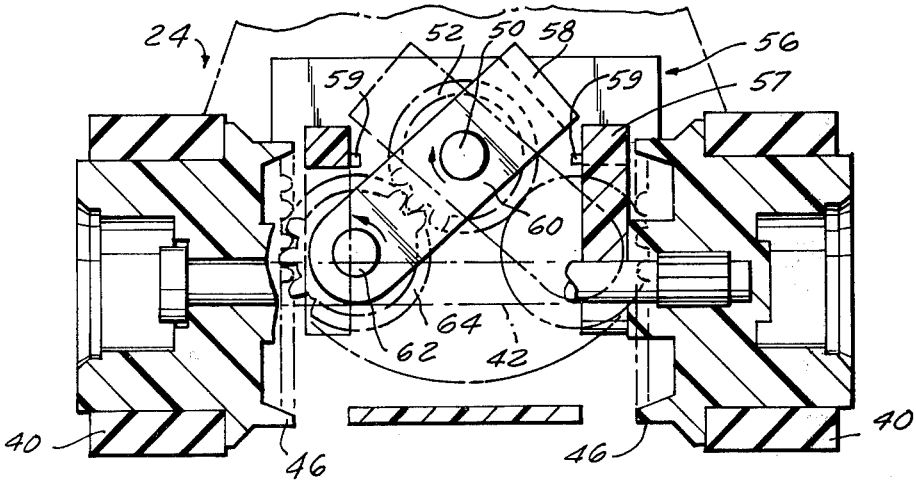
FIG. 5

TOY VEHICLE AND TOY VEHICLE GAME

This application is a continuation-in-part of U.S. patent application Ser. No. 783,722 filed Apr. 1, 1977, now U.S. Pat. No. 4,078,799 which is a division of U.S. patent application Ser. No. 747,441 filed Dec. 6, 1976, now abandoned. The disclosures of both said applications are incorporated herein by reference as though fully set forth herein.

The present invention relates to a toy vehicle and more particularly to a toy vehicle for use in a game in which toy vehicles are separately controlled by the players to enable them to turn out from one lane to the other and pass other vehicles on the track.

With the ever increasing popularity of toy vehicle games, such as for example the well known "slot car" games, there is an increasing demand for more realistic action. To this end attempts have been made in the past to provide "slot car" type games with speed control systems, as for example by varying current flow to the vehicles in the game. To further enhance such realism the slot arrangements in such games also provide for crossing the vehicles from one side of the track to another, to simulate an actual changing of lanes. However, the vehicle is in fact constrained to a fixed predetermined and unvariable path.

Since the play value of such previously proposed vehicle games is limited to the regulation of speed of travel, attempts have been made to provide toy vehicle games which enable an operator to control movement of the vehicle from one lane to the other without the constraint of a guide slot in the track. Such systems include for example the type shown in U.S. Pat. No. 3,797,404, wherein solenoid actuated bumpers are used to physically push the vehicle from one lane to the other by selectively engaging the bumpers along the side walls of the track. It is believed that this type of system will not insure movement of the vehicle from one lane to the other, particularly at slow speeds, and the bumper movements for pushing the vehicle, are not realistic.

Other attempts to provide for vehicle control for moving the vehicle from one lane to the other involve relatively complicated steering control mechanisms which respond to the switching on and off of current to the toy vehicle as supplied through contact strips in the track surface. Such systems are disclosed for example in U.S. Pat. Nos. 3,774,340 and 3,837,286. However, in addition to the relative complexity of the steering arrangements, the vehicles will of course lose speed when the current supply is shut off, so that the vehicle will slow down and the realistic effect desired to be produced is affected.

Still other steering systems have been provided in toy vehicles wherein the vehicle's steering is controlled in response to a reversal of the polarity of the current flow to the electrical drive motor in the vehicle. Such systems are disclosed for example in U.S. Pat. Nos. 3,453,970 and 3,813,812, which avoid the problem of stopping current flow completely to the motor so that there is little or no loss of speed, but their steering systems contain numerous moving parts which will wear and require constant attention. In U.S. Pat. No. 3,453,970 to Hansen, the electrical wires connecting the motor to the current collectors of the vehicle are used to aid in the steering operation and thus may well work loose during use of the vehicle. Another reversing polarity system is shown in U.S. Pat. No. 3,232,005 wherein the toy vehicle does not operate on a track and the steering control is not provided for switching lanes, but rather to provide an apparently random travel control for the vehicle.

Still another toy vehicle game which has been suggested to avoid the constraints of slot car type systems, is disclosed in U.S. Pat. No. 3,239,963 wherein a relatively complex steering control is provided which is responsive to the actuation of a solenoid mounted in the toy vehicle and is controlled remotely by the players.

It is an object of the present invention to overcome the limitations of previously proposed toy vehicle games wherein toy vehicles are permitted to turn out and move from one lane to the other without the restraint of a guide slot or the like.

Another object of the present invention is to provide a toy vehicle which is adapted to move along a guide track and change from one lane to the other, under the control of a player.

A further object of the present invention is to provide a toy vehicle having a relatively simple drive transmission responsive to the polarity of current flow to an electrical motor in the vehicle, to drive the vehicle in one or the other of the lanes of the track.

A still further object of the present invention is to provide a toy vehicle having a relatively simple drive transmission system which enables one or the other of its two rear drive wheels to be driven in response to the polarity of current supplied to the electrical motor in the vehicle.

Another object of the present invention is to provide a toy vehicle of the character described which is relatively simple in construction and durable in operation.

Yet another object of the present invention is to provide a toy vehicle and a control system therefor, which is relatively simple and economical to manufacture.

In accordance with an aspect of the present invention a toy vehicle is provided for use with one or more toy vehicles in a race game. The toy vehicle includes a frame, a body mounted on the frame, and a plurality of ground engaging wheels, including a pair of drive wheels. The drive wheels are mounted in the frame for independent rotation in laterally spaced vertical planes and a reversible electric motor is also provided for selectively driving the wheels. A drive transmission is mounted in the frame to connect the output of the electrical motor to the drive wheels. In one embodiment the drive transmission includes a spur gear on the output shaft of the motor and an idler support frame rotatably mounted on that shaft. The idler support frame carries an idler gear rotatably mounted thereon in meshing engagement with the spur gear whereby the support frame and idler gear are moved between first and second positions in response to the direction of rotation of the drive motor, thereby to drive one or the other of the drive wheels. The toy vehicles are preferably used on an endless track having laterally spaced side walls defining two vehicle lanes therebetween. When the vehicles are operated with only one or the other of their drive wheels driven from their respective motors, the vehicles will move into engagement with and be guided along one of these side walls.

The power supply to the electrical motors of the vehicles is provided through electrical contact strips located in the lanes of the vehicle track. This power supply system is constructed to enable the operators to separately control the speed of the vehicles and also to separately reverse the polarity of current flow to the electrical motors of the vehicles, whereby the vehicles will change lanes. In addition the vehicles are provided with a relatively simple shock absorbing front end system which absorbs the impact of the vehicle against the side walls during a lane change and directs the front wheels of the vehicle in the desired path of travel.

The above, and other objects, features and advantages of this invention will be apparent in the following detailed description of illustrative embodiments thereof, which are to be read in connection with the accompanying drawings, wherein:

FIG. 4 is a top plan view of the toy vehicle shown in FIG. 2, but with the body removed;

FIG. 5 is a sectional view taken along line 5—5 of FIG. 4;

FIG. 5A is a sectional view, similar to FIG. 5 of another embodiment of the invention;

Figure 1:
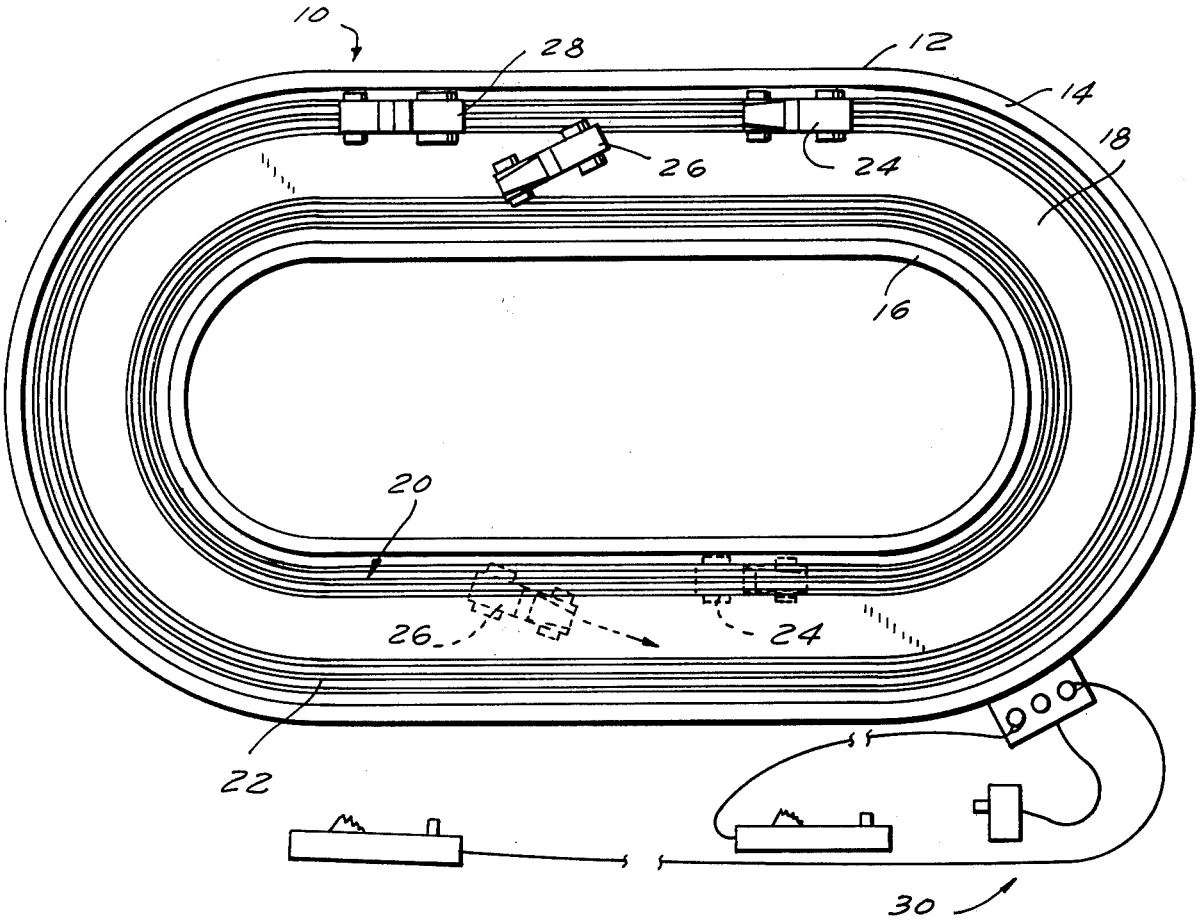
FIG. 1 is a plan view of a toy vehicle game constructed in accordance with the present invention.

Referring now to the drawings in detail, and initially to FIG. 1 thereof, the toy vehicle game 10, constructed in accordance with the present invention, includes an endless plastic track 12 having a pair of laterally spaced upstanding side walls 14, 16 and a road bed or tread surface 18 extending therebetween. The road bed 18 has a width sufficieint to define at least two vehicle lanes 20, 22 thereon along which a plurality of vehicles can be operated.

In the illustrative embodiment of the present invention the toy vehicle game includes operator controlled vehicles 24, 26 which are of substantial identical construction except for the arrangement of their current collectors as described hereinafter. In addition, a drone car 28, which moves along the track at a relatively constant speed may also be provided.

Vehicles 24, 26 are separately controlled by the players through a control system 30 which enables the players to vary current supply to the electrical motors in the vehicles, thereby to vary the vehicle speed. The controllers also enable the players to change the polarity of current supplied to the respective vehicle motors, whereby the vehicles can be switched by the players from one lane to the other. The drone car 28 on the other hand moves along the vehicle track at a constant speed providing an obstacle along the track which the player controlled cars 24, 26 must pass. The front wheels of the drone car are preferably canted in one direction or the other so that the drone will normally be driven in either the inner or the outer lane depending on the position of the wheels. This vehicle includes an electric motor operated by a battery contained within the vehicle, and connected through a direct drive transmission of any convenient construction to the rear wheels thereof. Preferably, drone vehicle 28 is of the type illustrated and described in detail in copending U.S. patent application Ser. No. 747,442 filed Dec. 6, 1976, now U.S. Pat. No. 4,078,798.

The disclosure of said U.S. patent application Ser. No. 747,442 is incorporated herein by reference.

Figure 2:
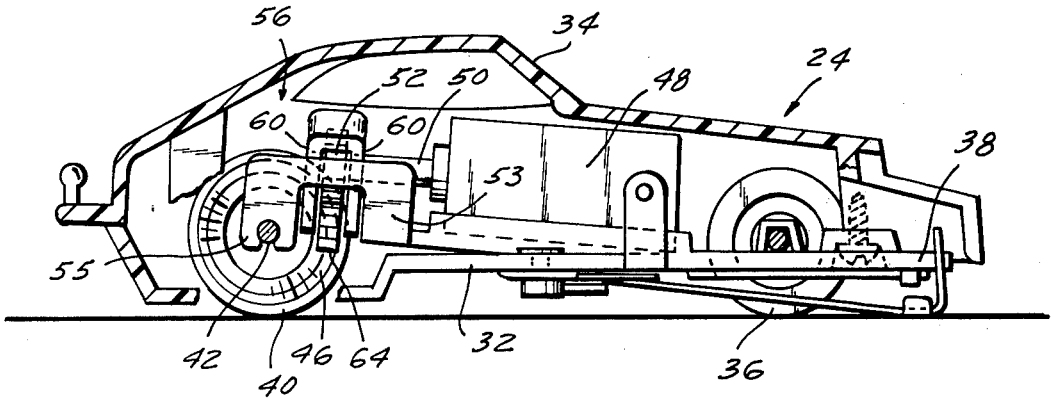
FIG. 2 is a longitudinal sectional view of the toy vehicle adapted for use with the game of FIG. 1.
Figure 3:
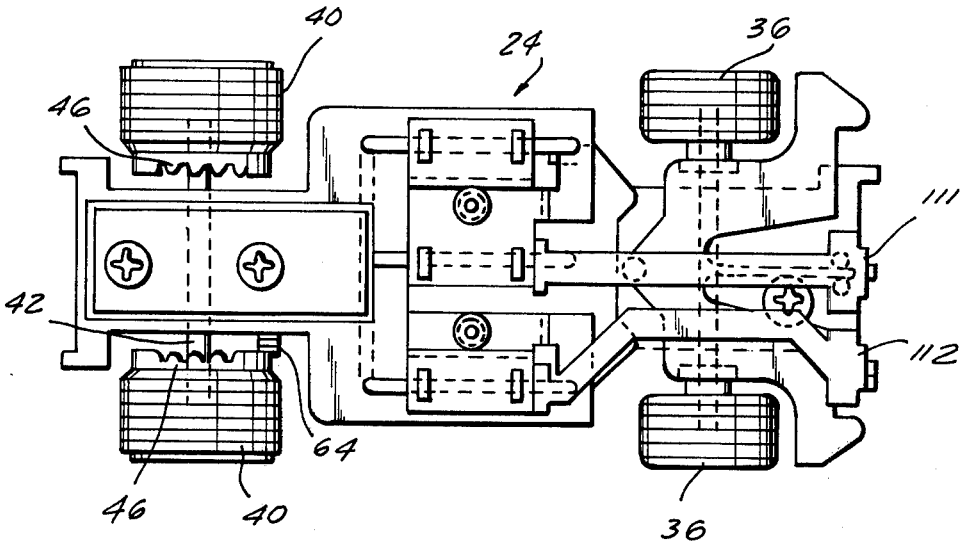
FIG. 3 is a bottom view of one of the toy vehicles illustrated in FIG. 1.

Toy vehicle 24 is illustrated in detail in FIGS. 2–4. As seen therein the vehicle includes a frame or chassis 32 of any convenient construction, and a removable plastic body or shell 34 which may be snap fit on frame 32 in any convenient manner. A pair of front wheels 36 are rotatably mounted on the frame, through a shock absorbing front end system 38, described more fully hereinafter, while the rear wheels 40 are rotatably mounted for independent rotation on a shaft 42 rotatably mounted in frame 32. (See FIG. 5). One of the drive wheels 40 is fixed on shaft 42 by a spline or the like, while the other of the wheels is freely rotatably mounted on the shaft. Alternatively both wheels can be freely rotatably mounted on the shaft or axle 42. With either arrangement the wheels can be separately and independently driven.

Each of the drive wheels 40 in the illustrative embodiment of the present invention is formed from either a molded plastic material or from a cast metal material, and has on its inner side an integral crown gear 46 formed thereon by which rotary power is supplied to the respective wheels. In one embodiment the wheels 40 have hubs formed of die cast metal having integrally formed gears 46 thereon and removable annular treads of rubber or the like are fitted over the hubs in the conventional manner.

The power for driving the toy vehicle is supplied from a D.C. electric motor 48 mounted on frame 32 in any convenient manner. The electric motor is of conventional D.C. construction and includes a rotary output member or shaft 50 connected to the rotor of the motor in the usual manner. In the embodiment of the invention ilustrated in FIG. 2 a spur gear or output drive element 52 is secured to shaft 50 for rotation thereby. This output member is drivingly engaged with the transmission system 56 which is responsive to the direction of rotation of the output drive element (i.e., the direction of rotation of output shaft 50 of motor 48, due to the polarity of current supplied to the motor) to selectively drive the drive wheels 40.

In the illustrative embodiment of the invention shown in FIGS. 2 and 4–6, transmission system 56 includes a generally U-shaped idler gear support frame 58 freely rotatably mounted on drive shaft 50 with its legs 60 located on opposite sides of the spur gear 52 and extending generally radially from shaft 50. The free ends of frame legs 60 have a shaft 62 rotatably mounted thereon on which an idler gear 64 is fixed. The idler gear is dimensioned and located to be continuously drivingly engaged with spur gear 52 and selectively engaged with gears 40, as seen in FIG. 5. As a result of this arrangement when motor 48 is operated the idler support frame, will be rotated in either a clockwise or counterclockwise direction, as seen in FIG. 5, depending upon the polarity of the current supplied to motor 48, as a result of the forces applied to the frame due to the engagement of gears 62 and 64. That is gears 52 and 64 will be continuously rotated by the operation of motor 48, and since frame 60 is freely rotatably mounted on the shaft 50, the engagement between gears 52, 64 will produce a resultant force on gears 62 which will tend to rotate frame 60 in the same direction as gear 52. Thus when gear 52 rotates in a clockwise or counterclockwise direction frame 60 will be driven in that same direction. As a result, as seen in FIG. 5, when gear 52 is rotated in a clockwise direction, indicated by the arrow X gear 64 will be rotated in a counterclockwise direction and frame 60 will rotate in a clockwise direction. This rotation of the frame brings gear 64 into driving engagement with the gear 46 on the left rear wheel 40 of the vehicle to drive that wheel, as shown in solid lines in FIG. 5. Because gear 64 and frame 60 are located to engage gear 46 forwardly of its axle 42, the wheel 40 is driven in a forward direction.

In the game illustrated in FIG. 1 when the vehicle is in the inside lane and power is supplied to its left rear wheel 40 in this manner, as a result of the polarity of current supplied to motor 48, the toy vehicle will be caused to move from the inner lane 22 to the outer lane 20, as is shown in dotted lines in FIG. 1 occurring with the vehicle 26. When this occurs the front end of the vehicle will engage the outer wall 14 of the track and the continued drive of its left wheel will cause the vehicle to move along wall 14 in outer lane 22.

On the other hand, when the polarity of current supplied to the motor 48 is reversed frame 60 will rotate in a counterclockwise direction, to the position shown in dotted lines in FIG. 5. When this occurs gear 64 will be rotated in an opposite direction and moved into engagement with gear 46 on the right driven wheel 40 (i.e., the lower wheel 40 in FIG. 6) so that this wheel is driven while the left wheel is free to rotate.

When the right wheel of the vehicle is driven in this manner, a bias is applied to the vehicle which will cause it to move to the left. Thus, as illustrated in FIG. 1 by the vehicle 26 shown in solid lines, when the vehicle is in the outer lane 22 of track 12 and the polarity of the current flow to the motor 48 is changed so that its right wheel 40 is driven, the vehicle will be biased towards its left into inner lane 20. When the front end of the vehicle hits inner wall 16 it will continue to move along that inner wall in inner lane 20 until the polarity of current supplied to motor 48 is again reversed. In this regard it is noted that because gear 64 is located forwardly of the axis of rotation of right wheel 40 the vehicle will be propelled in a forward direction regardless of the direction of rotation of the output element 52 of the motor.

Of course, if the vehicle is moving at a relatively high rate of speed as it goes about a curve in the track while in the inner lane, it may be propelled by centrifugal force into the outer lane. However, if the drive to the right hand wheel is maintained it will move inwardly again to the inner lane as previously described.

As seen most clearly in FIG. 2, the vehicle chassis 32 includes integral inverted U-shaped arms 53 having free ends 55 in which wheel shaft 42 is rigidly or rotatably mounted, as mentioned above. These arms are located inwardly of gears 46, as seen in FIG. 5A and their central bight portions provide clearance for gear 64 to engage gears 46. While engagement of gear 46 with one of the gears 64 will normally stop rotation of frame 60, the upper edge 57 of the bight portions of these arms will provide positive stops or limit positions for frame 60 in its two extreme positions. Alternatively frame 60 may be formed in dimensions such that it will not engage edge 57 but rather would pass along side arms 53 as it rotated. In that case positive stops or shoulders 59 could be provided on the inside faces of arms 53 as shown in dotted lines in FIG. 5.

Another embodiment of the invention, illustrated in FIG. 5A, uses a slightly different form of transmission system which also will selectively drive the right or left hand drive wheels of the toy vehicle according to the polarity of current supplied to the electric motor. In this embodiment of the invention the toy vehicle also includes a generally triangularly shaped idler frame 60' rotatably mounted on motor shaft 50 adjacent spur gear 52. This frame carries two rotatably mounted idler gears 64' thereon which are simultaneously rotated whenever current is supplied to motor 48. The gears 64' are laterally spaced so that only one of the gears engages a wheel gear 46 at any instant when power is supplied to the motor. By this arrangement frame 60' will be swung to the left or right depending on the direction of rotation of spur gear 52 to drive one of the rear wheels of the vehicle. This arrangement provides a slightly faster response time in switching the drive between the rear wheels. As with the previously described embodiment, by controlling the polarity of the motor, the operator can control which of the rear drive wheels of the vehicle will be supplied with power, so that the vehicle can be used in the game of FIG. 1, in the same manner as the vehicles previously described, to enable the operator to cause the vehicle to change position from one lane to the other.

In order to supply current to the toy vehicle track surface 18 is provided with a plurality of electrical contact strips in each of the lanes 20, 22. In the illustrative embodiment of the invention each lane is provided with three contact strips A, B and C respectively. The strips are formed of an electrically conductive metallic material and are embedded in the track so that they are substantially flush with the surface of the track and present no obstacle to movement of the vehicles from one lane to the other. Current is supplied to these strips, as described hereinafter, and is collected by current collectors mounted on the frame 32 of the toy vehicles in predetermined locations.

The contact strips in each lane are paired with each other, i.e., the A strip in one lane is electrically connected to the A strip in the other lane, the B strips are connected to each other and the C strips are connected to each other. The C strips are connected to electrical ground and the A and B strips are provided to separately supply current and control polarity of the current to the respective vehicles, so that two vehicles can operate in the same lane and still be separately controlled. For this reason the current collector and the vehicles are arranged to associate the respective vehicles with only one of the pairs of contact strips. For example, vehicle 24 will obtain current from strips B, while vehicle 26 will obtain current only from strips A.

Figure 3A:
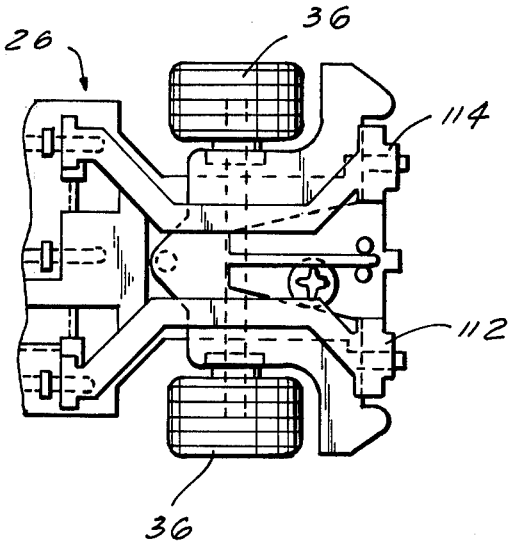
FIG. 3A is a bottom view of the front end portion of a second vehicle used in the game of FIG. 1.
Figure 6:
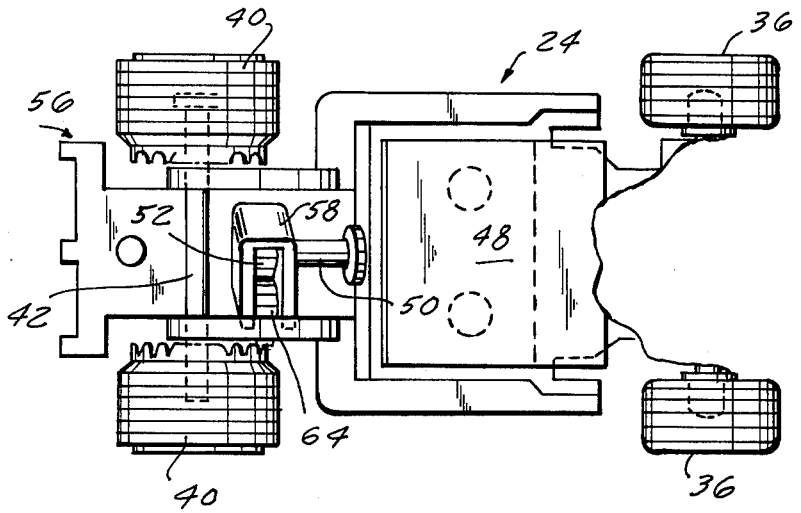
FIG. 6 is a top plan view similar to FIG. 4, but showing another position of the drive transmission of the vehicle.

As illustrated in FIG. 3 vehicle 24 is provided with two current collectors 111, 112 with the current collector 112 thereof positioned to contact ground strip C. Similarly vehicle 26, illustrated in FIG. 3A, has current collectors 112, 114 mounted thereon with current collector 112 located in the same position as the corresponding collector of vehicle 24 for also contacting the ground strip C. These current collectors are mounted on the vehicle in any convenient manner known in the art, and are electrically connected in a known manner to motor 48 of their respective vehicles. Current collector 111 of vehicle 24 is mounted on the vehicle to engage contact strips B regardless of which lane the vehicle is in. As seen in FIG. 3 this current collector is located centrally of the vehicle frame. On the other hand, the current collector 114 of vehicle 26 is located off center from the center line of the vehicle body and in spaced relation to its associated current collector 112.

This current collector is positioned to engage contact strips A regardless of the lane in which the vehicle is moving. By this arrangement, each of the operators can separately control current supply and polarity to contact strips A, B to control a respective one of the vehicles 24, 26 regardless of the lane occupied by the vehicle.

Figure 7:
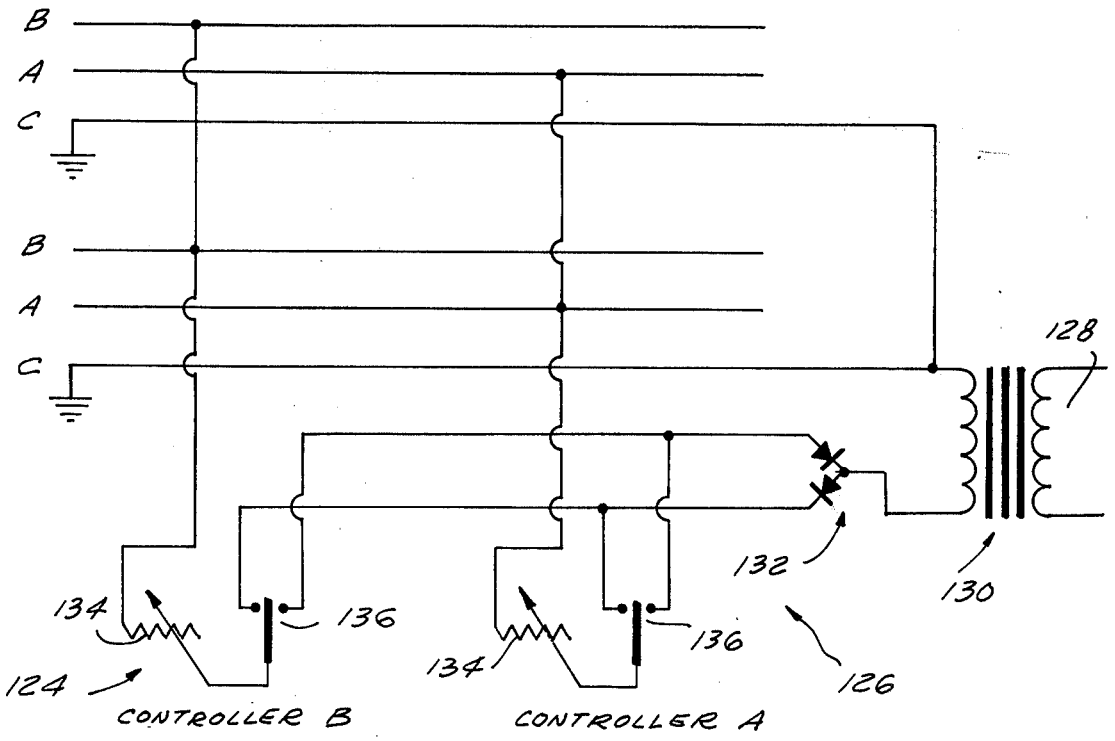
FIG. 7 is a schematic electrical circuit diagram of the electrical control system used for the toy vehicle game of FIG. 1.

The control system 30 for the toy vehicle game illustrated in FIG. 1, is shown schematically in FIG. 7. This control system includes respective controllers 124, 126 by which the players can control the vehicles 24, 26 respectively. Essentially the control system includes a plug 128 by which the system can be connected to an electrical AC power source, and it includes a transformer 130. Power is supplied from the transformer 130 through a halfwave rectifier 132 including two diodes connected as shown to separately supply current to the controllers 124, 126. Each controller is provided as a hand held unit and includes a variable resistor 134, operated as a trigger on the unit, as well as a single pole double throw switch 136. Current from controller 124 is supplied through its variable resistor 134 to the contact strips B and current from the controller 126 is supplied through its variable resistor to the contact strips A. The variable resistors may be of any convenient construction to permit the operators to vary the current supplied to their respective contact strips, and thus their respective vehicles, in order to vary the speed of the vehicles.

The polarity of the current supplied to the toy vehicles is separated and independently controlled by switches 136 so that polarity of current supplied to motor 48 of the respective vehicles, as controlled by the respective controllers, will vary in accordance with the position in which the switches 136 are placed. By this arrangement each player, using his controller 126 or 124, can control the speed of his vehicle along the track 12 and he can also variably position his vehicle along the track simply by changing the polarity of current supplied to the vehicle. As described above the polarity of the current supplied to the motor of the respective toy vehicles will determine which of the two rear drive wheels is powered, and this will determine which lane the vehicle will be driven to.

As illustrated in FIG. 1, when it is desired to switch a vehicle from the outer lane to the inner lane, as shown with vehicle 26, the polarity of current supplied to the vehicle is selected to drive the outer or right wheel of the vehicle thereby moving the vehicle leftwardly into the inner lane. Likewise, when it is desired to move the vehicle outwardly the inner or left wheel of the vehicle is driven, by properly selecting the polarity of current supplied to the motor of the vehicle, so that the vehicle will move toward the right and into the outer lane. Thus the operators have complete control over both the speed of the vehicle and the lane in which the vehicle will move.

As mentioned, the toy vehicles of the present invention include shock absorbing front ends 38, and these front ends preferably have the same structure and function as those described in my earlier applications and therefore will not be described in detail herein.

Accordingly it is seen that a relatively simply constructed toy vehicle game is provided in which players have complete independent control over the speed of operation of the toy vehicles, including the ability to cause the toy vehicles to shift independently from one lane to the other in order to pass each other or to pass a drone car moving along the track in a constant speed. This is achieved without the complexities of multiple element steering systems or solenoid bumper and steering arrangements. Moreover, it is accomplished with a simple change in polarity of the current flow to the toy vehicle's motor and eliminates the attendant loss of speed which occurs with previously proposed structures wherein lane changes are provided as a result of shutting off of power to the vehicle motor.

Although illustrative embodiments of the present invention have been described herein with reference to the accompanying drawings, it is to be understood that the invention is not limited to that precise embodiment, but that various changes and modifications may be effected therein by one skilled in the art without departing from the scope or spirit of this invention.

What is claimed is:

1. A toy vehicle comprising a vehicle frame, a pair of laterally spaced selectively driven combination drive and steering wheels mounted on the vehicle in laterally spaced relation to each other for independent rotation in fixed vertical planes, a reversible rotary drive motor mounted in said frame in a fixed position, a power output gear operatively connected to said motor for rotation thereby; and gear train means in said frame drivingly engaged with said output gear for selectively driving one or the other of said drive wheels in the forward driving direction in response to the direction of rotation of said output gear and for biasing the vehicle to move in a direction opposite to that of the side of the vehicle on which the driven wheel is located; said gear train means including gear means movably mounted in said frame for movement between first and second positions in response to the direction of rotation of said output gear for selectively driving one of said drive wheels in a forward direction of movement of the vehicle in said first position thereof and the other of said drive wheels in said forward direction in the second position thereof, while the undriven wheel free wheels; first and second drive gears respectively directly drivingly engaged with said drive wheels, said drive gears being located in said frame for selective engagement with said movably mounted gear means in the first and second positions thereof respectively; a gear support rotatably mounted in said vehicle between said rear wheels for rotation about an axis located generally in longitudinal alignment with the axis of rotation of said output gear, said movably mounted gear means being mounted on said gear support in driving engagement with said output gear thereby to cause said support frame to rotate in response to rotation of said output gear to engage said gear means with one or the other of said drive gears thereby to selectively drive said drive wheels in the forward direction of movement of the vehicle while the undriven wheel free wheels in response to the direction of rotation of said output gear whereby the vehicle is always driven in the forward direction regardless of the direction of rotation of said output gear.

2. A toy vehicle as defined in claim 1 wherein said output gear is a spur gear and said gear means in a single idler gear rotatably mounted in said gear support on an axis extending generally parallel to the axis of rotation of the spur gear; said first and second drive gears being crown gears fixed to their associated drive wheels in concentric relation and said spur gear being located to engage said crown gears in a vertical plane forwardly of the horizontal axis of rotation of the drive wheels in the forward driving direction of the vehicle.

3. A toy vehicle as defined in claim 1 wherein said output gear is a spur gear and said gear means comprises a pair of laterally spaced idler gears rotatably mounted in said gear support on axes extending generally parallel to the axis of rotation of said spur gear, said idler gears being respectively associated with said drive gears for selective driving engagement therewith upon rotation of said gear support in response to the rotational direction of said output gear, thereby to selectively drive said drive wheels; said first and second drive gears being crown gears fixed to their associated drive wheels in concentric relation and said spur gear being located to engage said crown gears in a vertical plane forwardly of the horizontal axis of rotation of the drive wheels in the forward driving direction of the vehicle.

4. In a toy vehicle game including a guide track having a pair of upstanding laterally spaced side walls defining a pair of parallely extending lanes therebetween, and at least one toy vehicle on said track including a frame, a body mounted on said frame, a plurality of ground engaging wheels mounted in said frame including a pair of combination drive and steering wheels; means for mounting said drive wheels in said frame for independent rotation in laterally spaced fixed vertical planes; a reversible electric motor having an ouput shaft and being mounted in said frame in a fixed position and drive transmission means mounted in said frame for selectively drivingly connecting said motor to the respective drive wheels to drive one or the other of the drive wheels in a forward direction regardless of the direction of rotation of said motor while the other wheel free wheels and for biasing the vehicle to move in a direction opposite to that of the side of the vehicle on which the driven wheel is located; said drive transmission means including at least one transmission element movably mounted in the frame for movement between first and second positions in response to the direction of rotation of the drive motor and a pair of direct drive gear drive trains respectively associated with said drive wheels and directly drivingly engaged therewith to respectively drive one or the other of said drive wheels in said forward direction when engaged by said movable transmission element; wherein the improvement comprises said movably mounted transmission element including a gear support frame rotatably mounted in said vehicle for rotation in a plane generally perpendicular to said output shaft and having at least one idler gear rotatably mounted thereon and drivingly engaged with said output shaft; said idler gear being located on said support frame for selective engagement with one or the other of said direct drive gear trains in said first and second positions in movably mounted transmission element to drive one or the other of the drive wheels in the forward direction while the other drive wheel free wheels and thus steer the vehicle in a desired direction, thereby to cause said vehicle to move into engagement with one or the other of said side walls depending upon the direction of rotation of said output shaft and hold the vehicle against the side wall in its selected lane until the polarity of current supplied to the motor is reversed.

5. In a toy vehicle as defined in claim 4 wherein said drive gear trains are crown gears respectively directly connected to said drive wheels and facing each other in laterally spaced relation with said idler gear being located therebetween to engage the crown gears in a vertical plane located forwardly of the axis of rotation of the crown gears in the direction of movement of the vehicle.

6. In a toy vehicle game including a frame, a vehicle body mounted on said frame, a plurality of ground engaging wheels rotatably mounted on said frame and including a pair of laterally spaced combination drive and steering wheels; means for mounting said drive wheels in said frame for independent rotation in laterally spaced fixed vertical planes; a reversible electric motor mounted in said frame in a fixed position and having a rotary power output element; drive transmission means mounted in said frame for selectively drivingly connecting said output element to the respective drive wheels to drive one or the other of the drive wheels in a forward direction of travel regardless of the direction of rotation of said output element while the other wheel free wheels and for biasing the vehicle to move in a direction opposite to that of the side of the vehicle on which the driven wheel is located; said drive transmission means including at least one transmission element movably mounted in said frame between first and second positions in response to the direction of rotation of said output element and a pair of direct drive gear trains respectively associated with said drive wheels and directly drivingly engaged therewith to respectively drive one or the other of said drive wheels in said forward direction when engaged by said movable transmission element; and means for selectively reversing the polarity of current supplied to said drive motor thereby to control the direction of rotation of said output drive element to selectively drive one or the other of said drive wheels; wherein the improvement comprises said movably mounted transmission element including a gear support frame rotatably mounted in said vehicle for rotation in a plane generally perpendicular to the axis of rotation of said output element and having at least one idler gear rotatably mounted thereon for rotation on an axis parallel to the axis of rotation of said output element and in operative engagement with said output element, said idler gear being located in said support frame for selective engagement with one or the other of said direct drive gear trains in said first and second positions of the movably mounted transmission element to drive one or the other of the drive wheels in the forward direction while the other drive wheel free wheels; said drive gear trains comprising crown gears respectively directly connected to said drive wheels and facing each other in laterally spaced relation with said idler gear being located therebetween to engage the crown gears in a vertical plane located forwardly of the axis of rotation of the crown gears in the direction of movement of the vehicle.

7. In a toy vehicle as defined in claim 6 including a pair of idler gears rotatably mounted on said gear support frame on axes generally parallel to the axis of rotation of said output element, said idler gears being respectively associated with said gear trains for respective operative engagement therewith in said first and second positions of the movably mounted transmission element.

8. In a toy vehicle game as defined in claim 7 wherein said drive transmission includes means for simultaneously driving said idler gears from said motor regardless of the direction of rotation of the motor whereby said support frame rotates in response to the rotation of said gears and in a direction determined by the direction of rotation of the drive motor thereby to selectively drivingly engage one of said idler gears with one of said gear trains in accordance with the drive direction of the motor.

9. In a toy vehicle game including at least two toy vehicles each of which comprises a frame, a vehicle body mounted on said frame, a plurality of ground engaging wheels rotatably mounted on said frame including a pair of laterally spaced combination drive and steering wheels; means for mounting said drive wheels in said frame for independent rotation in laterally spaced fixed vertical planes; a reversible electric motor mounted in said frame in a fixed position and having a rotary power output element; drive transmission means mounted in said frame for selectively drivingly connecting said output element to the respective drive wheels of its associated vehicle to drive one or the other of the drive wheels in a forward direction of travel regardless of the direction of rotation of said output element while the other wheel free wheels and for biasing the vehicle to move in a direction opposite to that of the side of the vehicle on which the driven wheel is located; said drive transmission means including at least one transmission element movably mounted in said frame between first and second positions in response to the direction of rotation of said output element and a pair of direct drive gear trains respectively associated with said wheels and directly drivingly engaged therewith to respectively drive one or the other of said drive wheels in said forward direction when engaged by said movable transmission element; and means for separately supplying current to the electric motors of the respective toy vehicles including means for independently and selectively reversing the polarity of the current supplied to the drive motors of the respective vehicles thereby to permit separate and independent control of the direction of rotation of the output drive elements of the respective motors to separately and independently control selection of the drive to the drive wheels of the respective wheels; said means for separately supplying current to the electric motors of said toy vehicles including a guide track for said vehicles defining an endless path of travel therefor including a pair of laterally spaced side walls having a width dimension defining two vehicle lanes permitting the vehicles to move along the track in parallel paths of travel; at least three electrically conductive contact strips located in parallel relation to each other in each of said lanes, with each strip in each lane being electrically connected to a corresponding strip in the other lane to define pairs of electrically connected contact strips and with one of said pairs of strips being connected to electrical ground; means for separately controlling current flow to the other two pairs of contact strips; and current collector means on each vehicle for electrically contacting the ground connected strip and one of the other strips in a lane for supplying current to the vehicle, with the current collector means on each of said two vehicles being respectively positioned to contact a different one of the strips in said other two pairs of strips whereby the vehicles' drive motors can be separately controlled in each lane and with both vehicles occupying the same lane, said strips in each lane being located with respect to said side walls of the track to contact the current collector means on the vehicles when the vehicles are engaged against said side walls, said movably mounted transmission element including a gear support frame rotatably mounted in said vehicle for rotation in a plane generally perpendicular to the axis of rotation of said output element and having at least one idler gear rotatably mounted thereon for rotation on an axis parallel to the axis of rotation of said output element and in operative engagement with said output element, said direct drive gear trains comprising crown gears respectively directly connected to said drive wheels and facing each other in laterally spaced relation, and said idler gear being located on said support frame between said crown gears and perpendicular thereto, forwardly of the axis of rotation of the crown gears for selective operative engagement therewith in said first and second positions of the movably mounted transmission element to drive one or the other of the drive wheels in the forward direction while the other drive wheel free wheels, whereby the vehicles are always driven in the forward direction through one or the other of their drive wheels regardless of the polarity of current supplied to the vehicle's motor while being biased against one or the other of said side walls in accordance with the polarity of current supplied to the vehicle, with the vehicle's current collectors remaining aligned with the contact strips of the lane the vehicle is in, until the polarity of current supplied to the motor is reversed.

10. In a toy vehicle as defined in claim 9 including a pair of idler gears rotatably mounted in said gear support frame on axes generally parallel to the axis of rotation of said output element, said idler gears being respectively associated with said crown gears for respective operative engagement therewith in said first and second positions of the movably mounted transmission element.

11. In a toy vehicle game as defined in claim 10 wherein said drive transmission includes means for simultaneously driving said idler gears from said motor regardless of the direction of rotation of the motor whereby said support frame rotates in response to the rotation of said gears and in a direction determined by the direction of rotation of the drive motor thereby to selectively drivingly engage one of said idler gears with one of said crown gears in accordance with the drive direction of the motor.

* * * * *